US006119271A

United States Patent [19]

Byon

[11] Patent Number: 6,119,271

[45] Date of Patent: Sep. 19, 2000

[54] GOLF GLOVE

[76] Inventor: Earnest Euiung Byon, 2215 Aloha Dr., #300, Honolulu, Hi. 96815

[21] Appl. No.: 09/461,296

[22] Filed: Dec. 15, 1999

[30] Foreign Application Priority Data

Aug. 23, 1999 [KR] Rep. of Korea ..... 99-17517

[51] Int. Cl.[7] ..... A41D 19/00

[52] U.S. Cl. ..... 2/161.2; 2/162; 2/163; 482/44

[58] Field of Search ..... 2/159, 160, 161.1, 2/161.2, 161.4, 161.3, 161.6, 162, 163, 167, 170, 917; 482/44.45, 47; 602/21, 22

[56] References Cited

U.S. PATENT DOCUMENTS

| | | | |
|---|---|---|---|
| 2,831,196 | 4/1958 | Scheiber | 2/161.1 |
| 3,124,806 | 3/1964 | Campbell et al. | 2/161.1 |
| 3,588,105 | 6/1971 | Donohoe | 273/32 |
| 3,838,853 | 10/1974 | Fredenhagen | 272/67 |
| 4,034,979 | 7/1977 | Wester | 273/54 |
| 4,042,975 | 8/1977 | Elliott, Jr. et al. | 2/19 |
| 4,368,883 | 1/1983 | Tiktin | 272/67 |
| 4,632,389 | 12/1986 | Moss | 272/119 |
| 4,684,123 | 8/1987 | Fabry | 272/119 |
| 4,813,079 | 3/1989 | Reitzel | 2/160 |
| 4,911,433 | 3/1990 | Walker et al. | 272/119 |
| 5,715,539 | 2/1998 | Benecki et al. | 2/160 |

*Primary Examiner*—John J. Calvert
*Assistant Examiner*—Katherine Moran
*Attorney, Agent, or Firm*—Staas & Halsey

[57] ABSTRACT

A golf glove with a hand part, a plurality of finger parts, a wrist end part, and a longitudinal slit extending longitudinally from a wrist end of the golf glove along both the wrist end part and the hand part, each of the parts having a back side and a palm side, the slit serving to divide the back side of each of the hand and wrist end parts into a larger portion and a smaller portion. The golf glove includes a group of mutually adjoining discrete first weight segments affixed to the larger back-side portion of the hand part, a group of mutually adjoining discrete second weight segments affixed to the smaller back-side portion of the hand part, a pair of wrist bands coupled to the hand part and adapted to secure the first weight segments on the hand part while completely covering the first weight segments, and a group of mutually adjoining discrete third weight segments affixed to the wrist end part along both the back and palm sides of the wrist end part, the third weight segments being arranged in the form of a single lateral line. The golf glove has an increased area for carrying weight segments, thereby being capable of achieving an increase in the number of weight segments affixed to the golf glove to achieve an increase in weight without any interference with the club grasp or swing of the user.

6 Claims, 5 Drawing Sheets

GOLF GLOVE

BACKGROUND OF THE INVENTION

1. Field of the Invention

The present invention relates to a golf glove, and more particularly to a weighted golf glove.

2. Description of the Prior Art

Typically, golf gloves have been used to protect the skin of the hand grasping the grip of a golf club while providing an enhancement in gripping qualities, thereby allowing the golfer to stably and firmly grasp the grip of the golf club.

Known golf gloves are mainly made of soft leather. Also, a golf glove provided with a buffering material at its back section is known to protect the skin of the hand. A golf glove is also known which is provided at its wrist portion with a strap adapted to tightly secure the wrist portion on the wrist of the user.

However, such known golf gloves provide only effects of enhancing gripping qualities and protecting the skin of the hand, as mentioned above. With such golf gloves, it is impossible to expect an improvement in a golfer's golf swing in terms of swing speed and stability and an enhancement in score.

In order to provide an improvement in a golfer's golf swing in terms of swing speed and stability and an enhancement in score, a weighted golf glove has been proposed which is, for example, disclosed in U.S. Pat. No. 5,898,943 issued to JongBok Kim.

The golf glove disclosed in U.S. Pat. No. 5,898,943 includes a plurality of weight segments made of lead to have a desired weight. The weight segments are arranged on the hand and finger parts of the golf glove at the back side of the golf glove.

Where a golfer wears this weighted golf glove, an increase in inertial mass is expected when he rotates the arm and hand about the shoulder to swing a golf club grasped by the hand. The increased inertial mass would improve the head speed of the golf club, thereby tremendously increasing the flying distance of a ball struck by the head of the golf club. Furthermore, it is also possible to provide an improved stability of back swing, down swing and follow through when swinging the golf club.

In order to obtain a further increase in inertial mass upon swing the golf club, it is necessary to increase the total weight of the weight segments affixed to the golf glove as much as possible. However, it is practically difficult to affix an increased number of weight segments to the golf glove due to a limited area of the golf glove for the affixing of the weight segments. To this end, lead having a relatively high specific gravity is used for the weight segments in order to obtain an increase in weight while using a reduced number of weight segments. However, lead is hazardous to the human body and involves environmental pollution. For this reason, the current worldwide tendency is to prohibit use of lead.

SUMMARY OF THE INVENTION

Therefore, an object of the invention is to solve the above mentioned problems and to provide a golf glove having an increased area for carrying weight segments, thereby being capable of achieving an increase in the number of weight segments affixed to the golf glove to achieve an increase in weight, so that the weight segments can be made of a material not hazardous to the human body and involving no environmental pollution.

Another object of the invention is to provide a golf glove having weight segments arranged on the golf glove at areas not interfering with the club grasp or swing of the user, thereby being capable of achieving an improvement in a golfer's golf swing in terms of swing speed and stability.

In accordance with one aspect, the present invention provides a golf glove comprising a hand part, a plurality of finger parts, a wrist end part, and a longitudinal slit extending longitudinally from a wrist end of the golf glove along both the wrist end part and the hand part, each of the parts having a back side and a palm side, the slit serving to divide the back side of each of the hand and wrist end parts into a larger portion and a smaller portion, further comprising: a group of mutually adjoining discrete first weight segments affixed to the larger back-side portion of the hand part; a group of mutually adjoining discrete second weight segments affixed to the smaller back-side portion of the hand part; a pair of wrist bands coupled to the hand part and adapted to secure the first weight segments on the hand part while completely covering the first weight segments; and a group of mutually adjoining discrete third weight segments affixed to the wrist end part along both the back and palm sides of the wrist end part, the third weight segments being arranged in the form of a single lateral line.

In accordance with another aspect, the present invention provides a golf glove comprising a hand part, a plurality of finger parts, a wrist end part, and a longitudinal slit extending longitudinally from a wrist end of the golf glove along both the wrist end part and the hand part, each of the parts having a back side and a palm side, the slit serving to divide the back side of each of the hand and wrist end parts into a larger portion and a smaller portion, further comprising: a group of mutually adjoining discrete first weight segments affixed to the larger back-side portion of the hand part; and a group of mutually adjoining discrete second weight segments affixed to the wrist end part along both the back and palm sides of the wrist end part, the second weight segments being arranged in the form of a single lateral line.

BRIEF DESCRIPTION OF THE DRAWINGS

Other objects and aspects of the invention will become apparent from the following description of embodiments with reference to the accompanying drawings in which.

DESCRIPTION OF THE PREFERRED EMBODIMENTS

A preferred embodiment of the present invention will be described hereinafter in conjunction with FIGS. 1 to 5, respectively.

Figure 1:
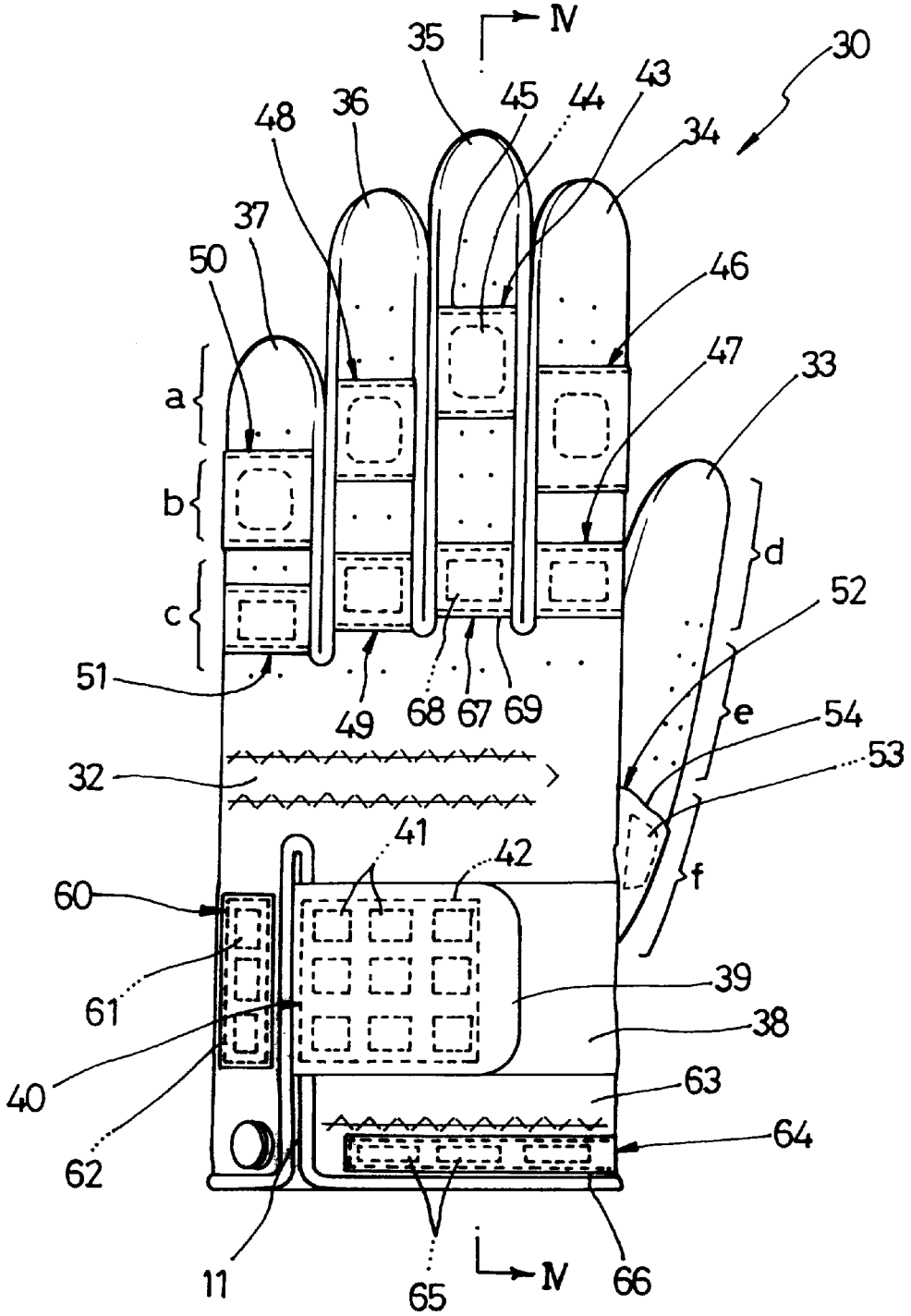
FIG. 1 is a plan view of a golf glove according to an embodiment of the present invention, illustrating an overlapping state of wrist bands.

Referring to FIG. 1, a weighted golf glove 30 according to a preferred embodiment of the present invention is illustrated. As shown in FIG. 1, the golf glove 30 includes several parts formed using treated and seamed leather. That is, the golf glove 30 includes a hand part 32 and a plurality of finger parts, namely, a thumb part 33, an index finger part 34, a middle finger part 35, a third finger part 36, and a little finger part 37. The golf glove 30 also includes a wrist end part 63. Each part of the golf glove 30 has a back side and a palm side. A longitudinal slit 11 extends longitudinally from a wrist end of the golf glove 30 along the wrist end part 63 and hand part 32. By this longitudinal slit 11, each of the hand and wrist end parts 32 and 63 is divided into a larger portion and a smaller portion at its back side.

Figure 2:
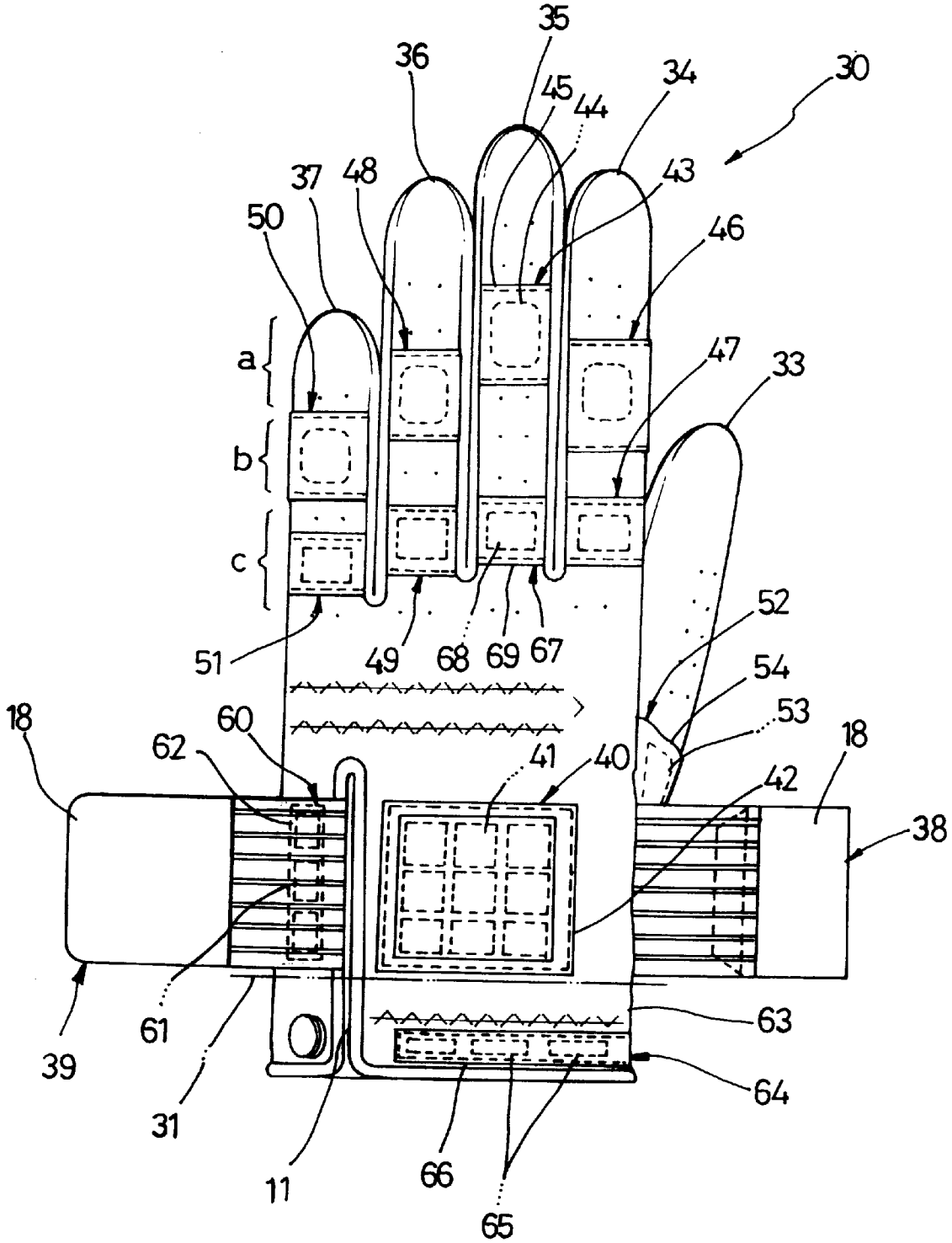
FIG. 2 is a plan view illustrating an open state of the wrist bands in the golf glove of FIG. 1.

As shown in FIG. 2, the golf glove 30 also includes a first hand weight part 40 and a second hand weight part 60 arranged on the back side of the hand part 32.

Figure 4:
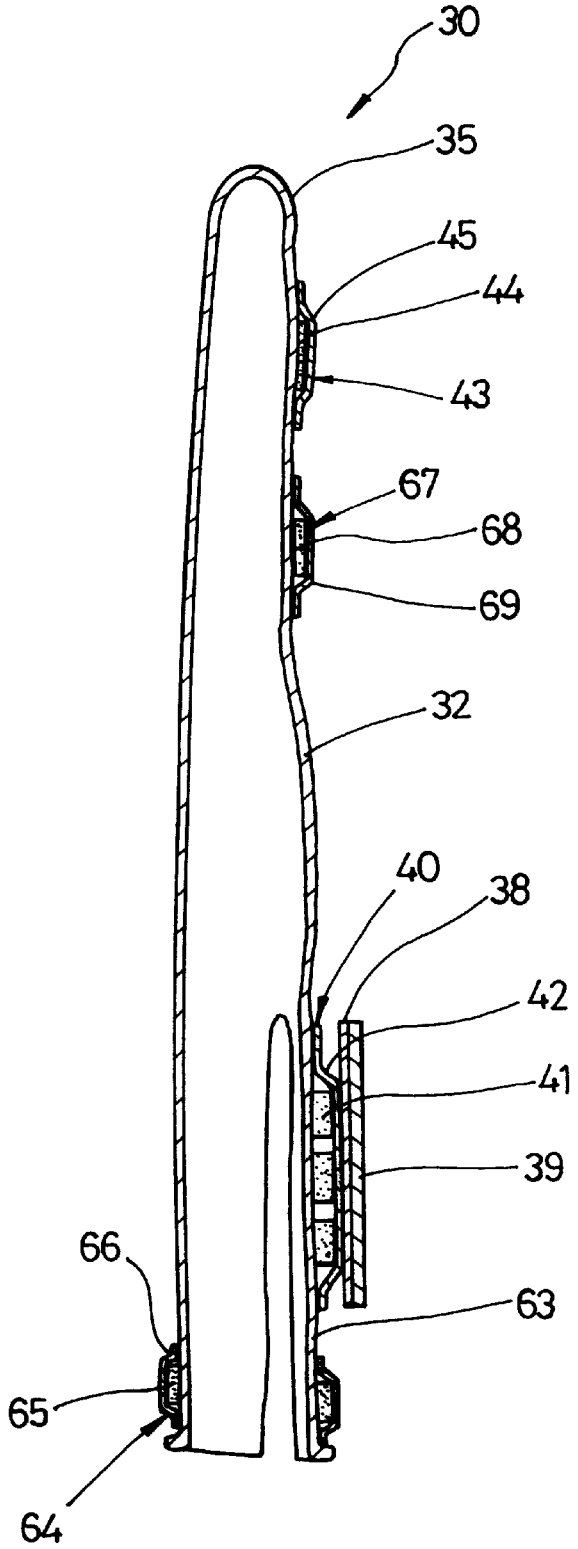
FIG. 4 is a cross-sectional view taken along the line IV—IV of FIG. 1.

A first wrist band 38 is coupled at one end thereof to a flank side of the hand part 32. Opposite to the first wrist band 38, a second wrist band 39 is coupled at one end thereof to a portion of the hand part 32 corresponding to the slit 11. As shown in FIG. 4, which is a cross-sectional view, the first wrist band 38 can overlap with the first hand weight part 40 in such a fashion that it completely cover the upper surface of the first hand weight part 40. The second wrist band 39 can also overlap with the first wrist band 38 to cover the first hand weight part 40. Although the second wrist bands 38 are adapted to cover only the first hand weight part 40 in the illustrated embodiment, it may be configured to cover both the first and second hand weight parts 40 and 60. This may be achieved by appropriately altering the coupled position of the second wrist band 39.

The first hand weight part 40 includes a group of mutually adjoining discrete first weight segments 41 affixed to the larger back-side portion of the hand part 32, and a cover 42 adapted to cover the first weight segments 41. The first weight segments 41 may be made of copper in their entirety. Alternatively, certain number of, e.g., three of the first weight segments 41 may be permanent magnets. In the illustrated case, the first hand weight part 40 has nine first weight segments 41 arranged in the form of a matrix array. The cover 42 is sewn on the back side of the hand part 32 at its ends.

The second hand weight part 60 includes a group of mutually adjoining discrete second weight segments 61 affixed to the smaller back-side portion of the hand part 32, and a cover 62 adapted to cover the second weight segments 61. The second weight segments 61 may be made of copper. In the illustrated case, the second hand weight part 60 has 3 second weight segments 61 arranged along a single longitudinal line. The cover 62 is sewn on the back side of the hand part 32 at its ends.

Figure 5:
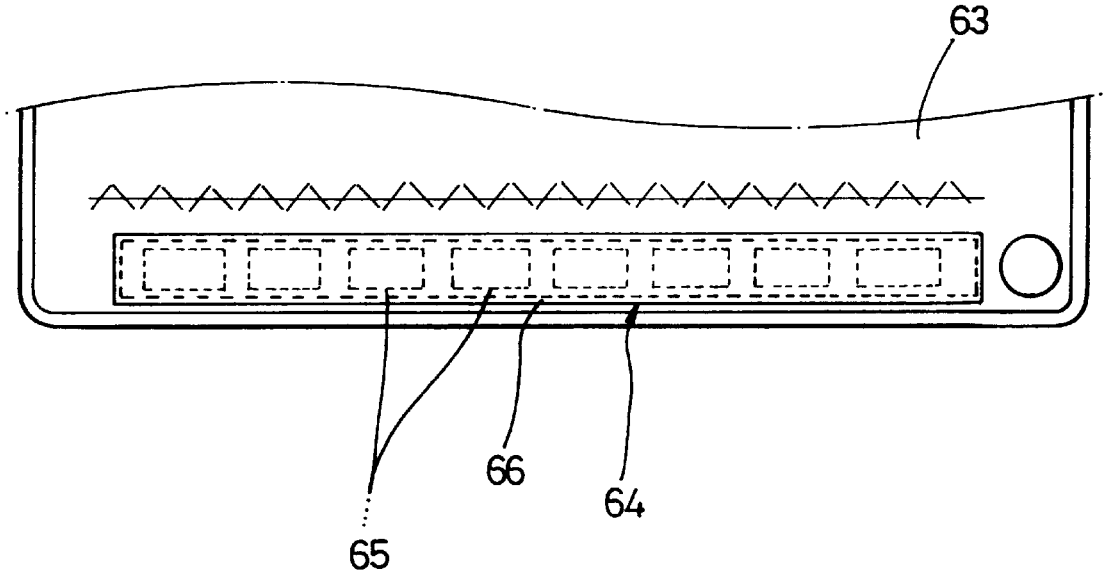
FIG. 5 is a plan view of the golf glove shown in FIG. 1, illustrating an open state of a wrist end part included in the golf glove.

The golf glove 30 further includes a wrist end weight part 64 arranged on the wrist end part 63 in such a fashion that it extends laterally along both the back and palm sides of the wrist end part 63, as shown in FIGS. 2, 4 and 5. The wrist end weight part 64 includes a group of mutually adjoining discrete third weight segments 65 affixed to the wrist end part 63 along both the back and palm sides of the wrist end part 63, and a cover 66 adapted to cover the third weight segments 65. The third weight segments 65 may be made of copper. In the illustrated case, the wrist end weight part 64 has 9 third weight segments 65 arranged in the form of a single lateral line. The cover 66 is sewn on the back and palm sides of the wrist end part 63 at its ends.

Among the first and second weight segments 41 and 61 respectively included in the first and second hand weight parts 40 and 60, those positioned nearest to the wrist end part 63 are arranged along the joint of the user' hand indicated by a double-dotted line 41 in FIG. 2. By virtue of this arrangement, it is possible to reduce the inertial mass caused by a hand's rotary motion about the wrist joint, as compared to the case in which weights are arranged far from the wrist. Accordingly, this invented golf glove increases the whole inertial mass of the arm and hand while preventing an unnatural force from being applied to the wrist joint. Thus, a natural swing (back swing, down swing and follow through) is possible.

In accordance with the illustrated embodiment of the present invention, the golf glove 30 also includes a plurality of finger weight parts arranged in pair on the finger parts, respectively, as shown in FIG. 1. That is, a pair of finger weight parts 43 and 67 are arranged on respective back sides of middle and base portions b and c of the middle finger part 35 at opposite sides of a middle knuckle portion of the middle finger part 35, as shown in FIG. 1. Each finger weight part 43 or 67 includes an independent weight segment 44 or 68, and a cover 45 or 69 adapted to cover the weight segment 44 or 68. Each cover 45 or 69 is sewn at its ends on the back side of the associated portion of the middle finger part 35, namely, the middle and base portion b or c, while covering the associated independent weight segment 44 or 68, in order to affix it to the middle finger part 35. Similarly, the index finger part 34, third finger 35, and little finger part 37 include pairs of finger weight parts 46 and 47; 48 and 49; and 50 and 51, respectively. The finger weight parts in each pair are arranged on respective back sides of middle and base portions b and c of the associated finger part. Since the independent weight segment of each finger weight part is disposed between adjacent knuckles of the associated user' finger, it does not interfere with motions of finger bones about those knuckles.

A single finger weight part 52 is arranged on the back side of a base portion f of the thumb part 33, as shown in FIG. 1. The top and middle portions of the thumb part 33 are denoted by the reference characters d and e in FIG. 1, respectively. The finger weight part 52 includes an independent weight segment 53 made of copper, and a cover 54 adapted to cover the weight segment 53. The cover 54 is sewn at its ends on the back side of the base portion f of the thumb part 33 while covering the weight segment 53, in order to affix it to the thumb part 33.

Figure 3:
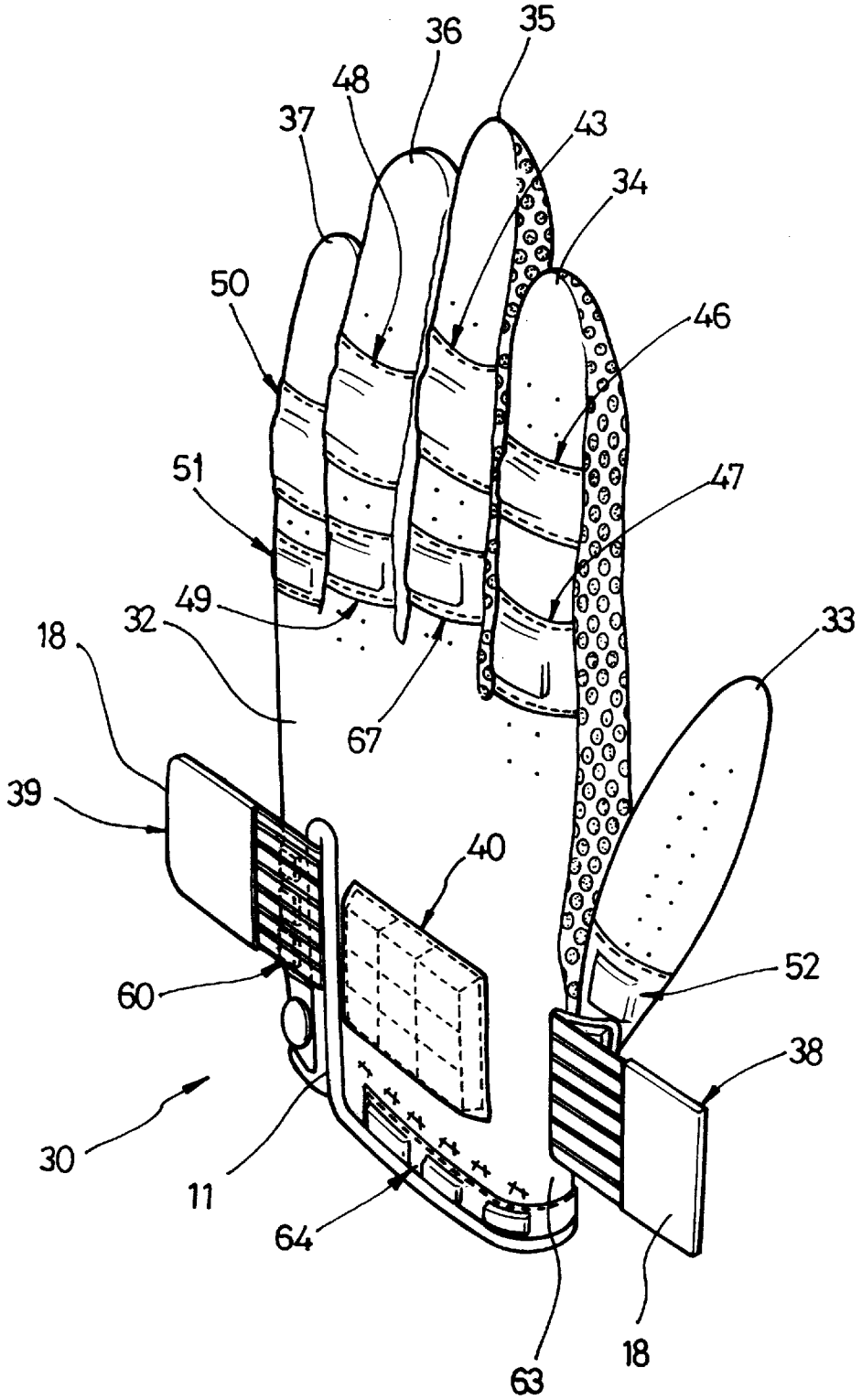
FIG. 3 is a perspective view of the golf glove shown in FIG. 2.

As shown in FIGS. 2 and 3, the first and second wrist bands 38 and 39, each of which is sewn at one end thereof on the back side of the hand part 32, face each other at opposite sides of the first hand weight part 40 on the back side of the hand part 32. Each of these wrist bands 38 and 39 is provided at the other end thereof with a tape fastener 18 such as a VelcroTape (trademark). When the tape fasteners 18 of the first and second wrist bands 38 and 39 overlap with each other, they firmly couple the first and second wrist bands 38 and 39 together.

That is, when the tape fasteners 18 are interlocked together in a state tightening the wrist of the user, the first weight segments 41 are tightly secured on the wrist of the user. Each of the first and second wrist bands 38 and 39 has a width more than the longitudinal width of the array of the first weight segments 41 in order to completely cover the first weight segments 41.

By virtue of this configuration, the first weight segments 41 can be tightly secured on the back of the user's hand. Thus, an improvement in the security of the golf glove on the user' hand is achieved. This prevents the center of weight of the first weight segments 41 from being shifted from a position on the back of the user's hand due to a separation of the first weight segments 41 from the back of the user's hand. Also, the arm of the user maintains a stable status during the swing motion of the user, so that the head of the golf club maintains an accurate arc-shaped trace during the swing motion.

As apparent from the above description, a variety of effects are obtained in accordance with the illustrated embodiment of the present invention. First, an increase in inertial mass is obtained by virtue of the weight of the weight segments affixed to the golf glove when the user rotates the arm and hand about the shoulder to swing a golf club grasped by the hand. The increased inertial mass serves to improve the head speed of the golf club, thereby tremendously increasing the flying distance of a ball struck by the head of the golf club. Second, it is possible to provide an improved stability of back swing, down swing and follow through when swinging the golf club, by virtue of the increased inertial mass. That is, the increased inertial mass generates, during the swing motion of the user, a force applied to the elbow joint of the user in a direction in which the elbow of the user is stretched. Accordingly, it is possible to prevent an unnatural bending of the user's elbow during the swing motion, thereby achieving an ideal back swing, down swing or follow through. Third, if a golfer is right-handed, an effect is expected in which the right hand keeps less power by virtue of the increased inertial mass of the left hand worn the golf glove. Accordingly, it is possible to prevent slicing of the ball caused by distributing more power to the right hand.

Although the weight segments have been described as being made of copper in the illustrated embodiment, they are not limited to this material. The weight segments may be made of a magnetic material, bioceramic or jade exhibiting an effect of promoting circulation of blood to provide an effect of treating or releasing diseases such as neuralgia, myalgia, phlegm, and chronic fatigue.

Although the golf glove 30 has been described as being made of treated and seamed natural leather in the illustrated embodiment, it is not limited to this material. For example, synthetic leather or vinyl may be used to form the golf glove 30. Also, the hand part 32, wrist bands 38 and 39, and covers 42, 45, 54, 62, 66, and 69 may be made of different materials, respectively.

Such a wide selection range for materials used for the golf glove makes it possible to provide golf gloves of diverse manufacturing costs. It is also possible to provide a golf glove made of a material favorable to the user. Since most preferable materials for different parts of the golf glove can be selected in accordance with respective functions of those parts, it is possible to provide a golf glove exhibiting improvements in natural security, grasp, and durability.

The weight of each weight segment is appropriately selectable without being limited to a specific value in accordance with the present invention.

Accordingly, a consumer can purchase a golf glove with weight segments of a weight favorable to him. Furthermore, the purchaser can change the weight distribution on each part of the golf glove even after purchase.

In the illustrated embodiment, each weight segment is affixed to the back side of the golf glove by the cover while being prevented from being separated from the golf glove. However, the affixing of the weight segment is not limited to the illustrated means. Although not shown, the weight segment may be affixed to the back side of the golf glove in such a fashion that it is separable from the golf glove using a means, such as a fastener, for opening an end of the cover.

Where the weight of the weight segments affixed to the golf glove is excessively high for the user, it may be appropriately reduced by partially removing the weight segments.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

As apparent from the above description, the present invention provides a golf glove having an increased area for carrying weight segments, thereby being capable of achieving an increase in the number of weight segments affixed to the golf glove to achieve an increase in weight without any interference with the club grasp or swing of the user. Accordingly, it is possible to achieve an improvement in a golfer's golf swing in terms of swing speed and stability. Also, the weight segments can be made of a material such as iron, copper, ceramic, or jade, or a magnetic material, instead of lead known as a material hazardous to the human body. Where the weight segments are made of a magnetic material, bioceramic or jade, there is an effect of promoting blood circulation and thereby relieving diseases such as neuralgia, myalgia, phlegm, and chronic fatigue.

What is claimed is:

1. A golf glove comprising a hand part, a plurality of finger parts, a wrist end part, and a longitudinal slit extending longitudinally from a wrist end of the golf glove along both the wrist end part and the hand part, each of the parts having a back side and a palm side, the slit serving to divide the back side of each of the hand and wrist end parts into a larger portion and a smaller portion, further comprising:

a group of mutually adjoining discrete first weight segments affixed to the larger back-side portion of the hand part;

a group of mutually adjoining discrete second weight segments affixed to the smaller back-side portion of the hand part;

a pair of wrist bands coupled to the hand part and adapted to secure the first weight segments on the hand part while completely covering the first weight segments; and a group of mutually adjoining discrete third weight segments affixed to the wrist end part along both the back and palm sides of the wrist end part, the third weight segments being arranged in the form of a single lateral line.

2. The golf glove according to claim 1, further comprising:

a plurality of independent weight segments affixed to the back sides of the finger parts in such a fashion that at least one of the independent weight segments is arranged at each of the finger parts.

3. A golf glove comprising a hand part, a plurality of finger parts, a wrist end part, and a longitudinal slit extending longitudinally from a wrist end of the golf glove along both the wrist end part and the hand part, each of the parts having a back side and a palm side, the slit serving to divide the back side of each of the hand and wrist end parts into a larger portion and a smaller portion, further comprising:

a group of mutually adjoining discrete first weight segments affixed to the larger back-side portion of the hand part; and a group of mutually adjoining discrete second weight segments affixed to the wrist end part along both the back and palm sides of the wrist end part, the second weight segments being arranged in the form of a single lateral line.

4. The golf glove according to claim 3, further comprising:

a group of mutually adjoining discrete third weight segments affixed to the smaller back-side portion of the hand part.

5. The golf glove according to claim 4, further comprising:

a plurality of independent weight segments affixed to the back sides of the finger parts in such a fashion that at least one of the independent weight segments is arranged at each of the finger parts.

6. The golf glove according to claim 3, wherein each of the first and second weight segments is made of a material selected from the group consisting of lead, iron, copper, ceramic, jade, and a magnetic material.

* * * * *